United States Patent [19]

Tobey

[11] Patent Number: 4,653,785

[45] Date of Patent: Mar. 31, 1987

[54] TEMPORARY DOOR LOCK STRUCTURE

[76] Inventor: Richard D. Tobey, 1074 Rockdell Ct., Beavercreek, Ohio 45430

[21] Appl. No.: 697,031

[22] Filed: Jan. 31, 1985

[51] Int. Cl.[4] ..... E05C 19/18

[52] U.S. Cl. ..... 292/258; 29/150; 29/526 R

[58] Field of Search ..... 292/258, 288, 292, 293, 292/294, 295, 296, 148; 70/14

[56] References Cited

U.S. PATENT DOCUMENTS

| | | | |
|---|---|---|---|
| 2,536,941 | 1/1951 | Jones | 292/288 |
| 2,638,371 | 5/1953 | Kennedy | 292/288 |
| 3,181,319 | 5/1965 | Hudon | 292/292 X |
| 3,834,746 | 9/1974 | Hinden | 292/290 |
| 3,997,206 | 12/1976 | Hagopian | 292/258 X |
| 4,062,576 | 12/1977 | Jennings et al. | 292/258 |
| 4,198,088 | 4/1980 | Tochihara | 292/288 |
| 4,326,394 | 4/1982 | Stein | 70/14 |
| 4,399,672 | 8/1983 | Moorhouse | 292/292 X |
| 4,405,165 | 9/1983 | Johns | 292/258 |
| 4,529,235 | 7/1985 | Florentine, Sr. | 292/258 |

*Primary Examiner*—Richard E. Moore

*Attorney, Agent, or Firm*—Jacox & Meckstroth

[57] ABSTRACT

A device or structure for temporarily securing and locking a door in closed condition. The door is hingedly mounted within a door frame. The device or structure of this invention comprises an attachment member which includes a bracket and at least one arm member. The bracket is positioned upon an upper corner of the door and covers a portion of the upper corner of the door. An arm or arms extend from the bracket. When the door is in a closed position the arms extend beyond the door frame. A retainer plate is positioned upon the arms and in juxtaposition with the door frame. A padlock or the like is attached to at least one of the arms and maintains the retainer plate upon the arms and in juxtaposition with the door frame. Thus, the door is secured in its closed position.

4 Claims, 13 Drawing Figures

TEMPORARY DOOR LOCK STRUCTURE

BACKGROUND OF THE INVENTION

Certain doors in several types of environment are not provided with locks. For example, rooms for patients in a hospital conventionally are not provided with locks. However, if a hospital is not filled to capacity with patients, a patient room in the hospital may not be occupied.

It has been found that an unoccupied patient room in a hospital is subject to theft of articles in the room. Therefore, it is desirable to provide means by which an unoccupied patient room in a hospital may be temporarily locked.

There are other types of situations and buildings in which a door which is not provided with a lock should be temporarily locked.

It is therefore an object of this invention to provide a device or structure by which a door can be temporarily locked in a closed condition.

It is another object of this invention to provide such a device or structure by which a door can be temporarily locked without detracting from the appearance of the door and without any damage to the door and without marring the door or door frame.

Other objects and advantages of this invention reside in the construction of parts, the combination thereof, the method of production and the manner of use, as will become more apparent from the following description.

SUMMARY OF THE INVENTION

A temporary door lock device of this invention comprises an attachment member which includes a bracket which is positioned upon the upper edge of a door which is hingedly supported within a door frame. An arm or arms extend from the bracket to a position beyond the door frame. A retainer, in the form of a rigid plate or the like, has an opening or openings to receive the arm or arms. The rigid plate is positioned in front of an upper corner of the door frame. A locking device is attached to an arm of the bracket and maintains the retainer upon the arm. The door is thus secured against opening.

DETAILED DESCRIPTION OF THE INVENTION

Figure 1:
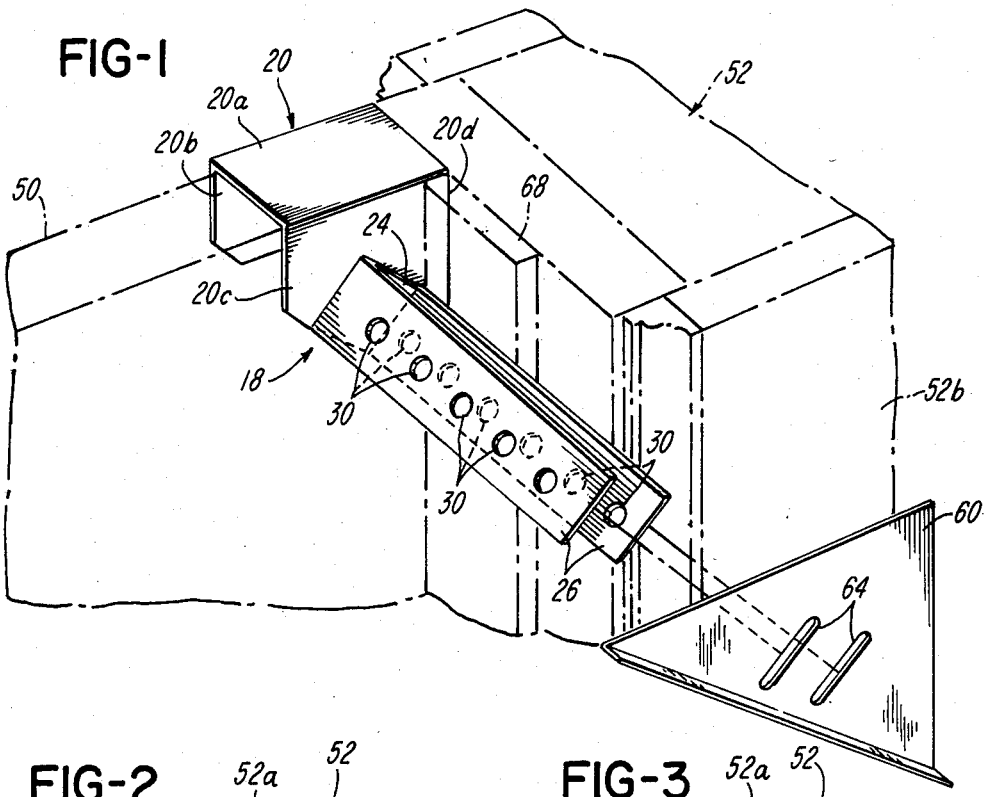
FIG. 1 is a fragmentary perspective view, partially exploded, illustrating an attachment member of a temporary door lock device or structure of this invention in position upon a door, with the door in closed position within a door frame, and showing a retainer member of the device in position for assembly.
Figure 2:
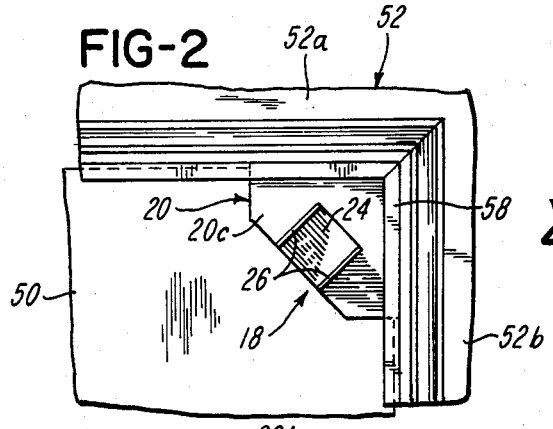
FIG. 2 is a fragmentary front elevational view, drawn on a slightly smaller scale than FIG. 1, showing the door positioned as in FIG. 1 and showing an attachment member of this invention supported by the door.

FIGS. 1–5 illustrate an embodiment of the temporary locking structure of this invention. The structure of FIGS. 1–5 comprises an attachment member 18 which includes a bracket 20, which is provided with a top wall **20*a*, side walls 20*b* and 20*c*, and an end wall 20*d*. The attachment member 18 also includes a base 24 which has a pair of arms 26 attached thereto. The base 24 is attached to the side wall 20*c*. The arms 26 extend laterally from the side wall 20*c*. Each of the arms 26 has a series of apertures 30** therethrough.

FIGS. 1–5 illustrate a door 50, which is hingedly mounted within a door frame 52. The door frame 52 is provided with a horizontal upper portion **52*a* and a vertical side portion 52*b*. The door 50 is shown in a closed position within the door frame 52. The bracket 20 is positioned upon the upper corner of the door 50 prior to closing of the door 50. The top wall 20*a* of the bracket 20 covers a portion of the upper edge of the door 50. The side walls 20*b* and 20*c* of the bracket 20 cover parts of opposite sides of the upper portion of the door 50. The end wall 20*d* of the bracket 20 covers a part of the vertical edge of the door 50. The end wall 20*d* of the bracket 20 is between the door 50 and the vertical portion 52*b* of the door frame 52, when the door 50 is closed. The door 50, in its closed position, is against a jam 58 which is attached to the door frame 52**.

Figure 4:
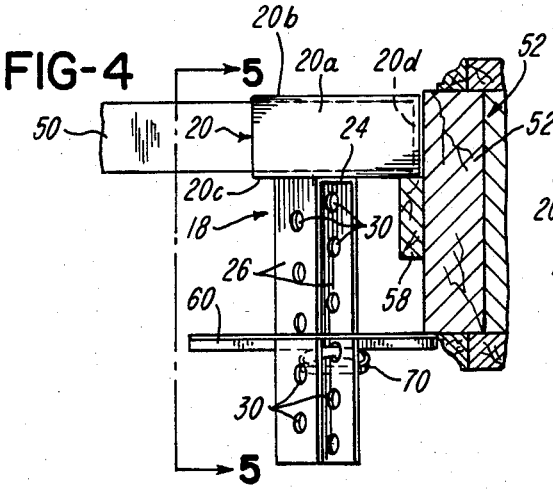
FIG. 4 is a sectional view taken substantially on line 4—4 of FIG. 3.
Figure 5:
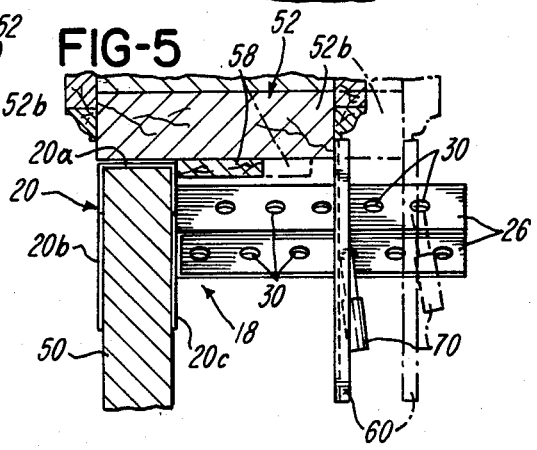
FIG. 5 is a sectional view taken substantially on line 5—5 of FIG. 4.
Figure 6:
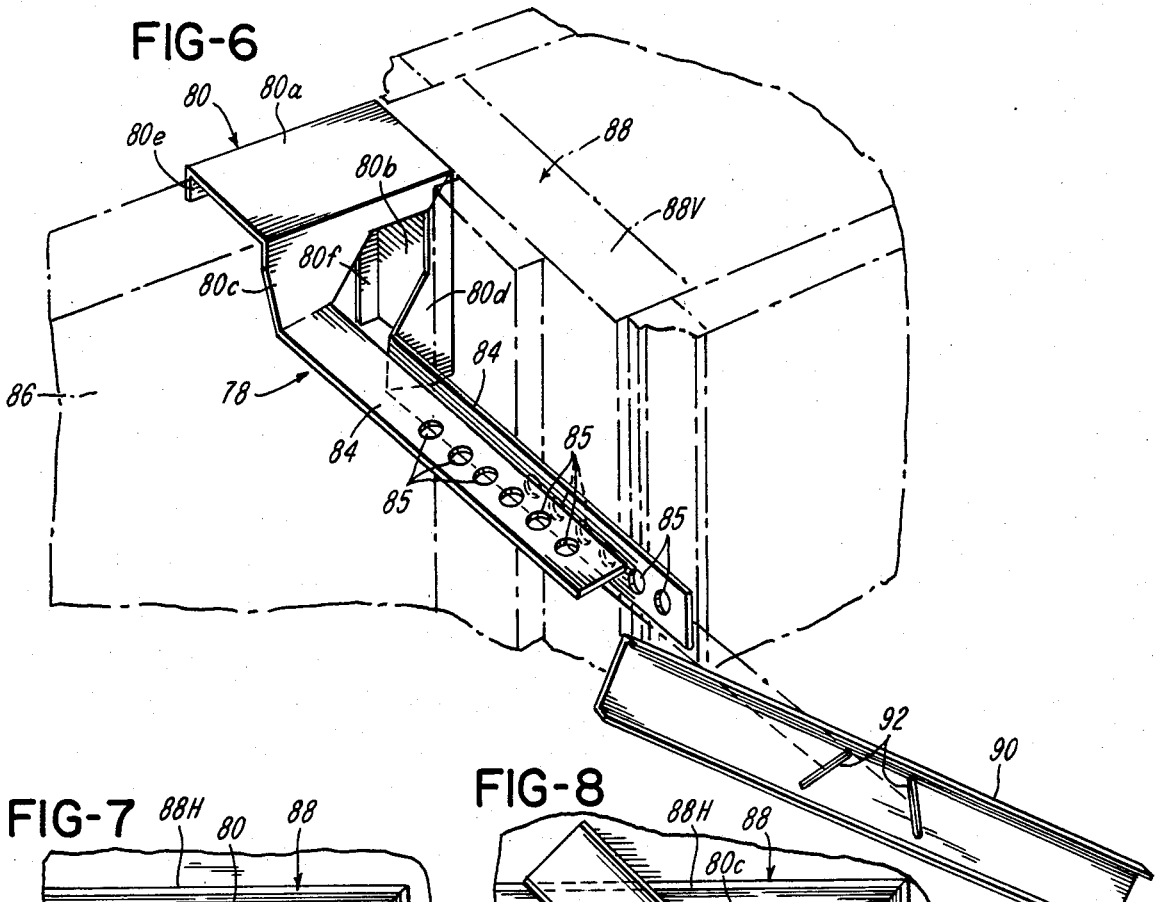
FIG. 6 is a fragmentary perspective view, similar to FIG. 1, and illustrating a modification in the temporary door lock device or structure of this invention.
Figure 7:
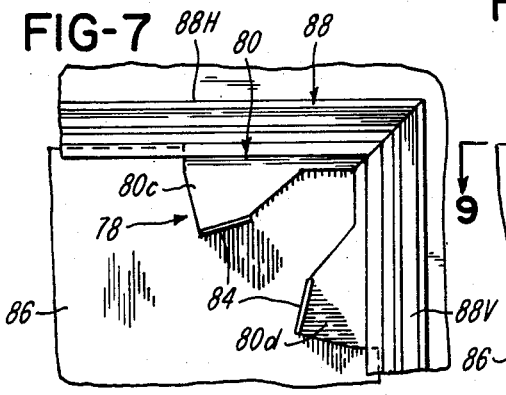
FIG. 7 is a fragmentary front elevational view similar to FIG. 2, illustrating the modification of FIG. 6.

The arms 26 which are attached to the base 24 and to the side wall **20*c*, extend from the door 50 in a position beyond the door frame 52, as best shown in FIGS. 4 and 5**.

Figure 3:
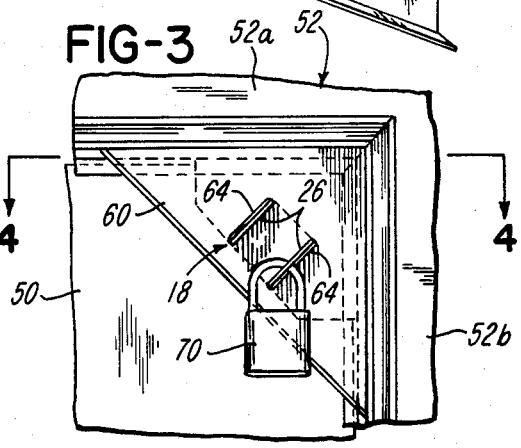
FIG. 3 is a fragmentary front elevational view, drawn on substantially the same scale as FIG. 2, showing the door in the same position as in FIGS. 1 and 2, and showing the attachment member in position and showing the retainer member in position upon the attachment member and showing a padlock attached to an arm of the attachment member to maintain the retainer member in position and to secure the door in closed position.

A retainer member, shown herein in the form of a rigid plate 60 is a part of the device or structure of this invention. The rigid plate 60 is provided with elongate openings 64 therethrough. The openings 64 are adapted to receive the arms 26 as the arms 26 extend from the door 50, through the rigid plate 60 and to a position beyond the door frame 52. When the retainer member 60 is placed upon the arms 26, the retainer member 60 is moved upon the arms 26 toward the door frame 52, to a position close to the door frame 52 and in front of the door frame 52. The retainer member 60 then has portions in front of and in juxtaposition with the horizontal portion **52*a* of the door frame 52** and with the vertical portion 52*b* of the door frame 52, as illustrated in FIGS. 3, 4, and 5. Then a padlock 70 or the like is attached to at least one of the arms 26, as a part of the padlock 70 extends through at least one of the apertures in the arm or arms 26, as illustrated in FIGS. 3, 4, and 5.

Thus, the door 50 is secured in a closed position and cannot be opened until the padlock 70 and the rigid plate 60 are removed from the arm 26.

FIG. 5 illustrates that the locations of the apertures 30 in the arms 26 are such that the retainer member 60 is positioned adjacent at least one of the apertures 30 when the retainer member 60 is in juxtaposition with the door frame 52. Thus, the proper aperture 30 is available to receive the padlock 70 to maintain the retainer member 60 in juxtaposition with the door frame 52 to secure the door 50 in closed position.

FIGS. 1–6 illustrate a door which opens at the right hand side thereof. When the temporary lock structure of this invention is used to secure a door which opens at the left hand side thereof, the bracket 20 is positioned so that the upper wall 20*a* is at the edge of the door, and the end wall 20*d* is positioned at the top surface of the door.

FIGURES 6–13

FIGS. 6–13 illustrate another embodiment of the temporary door lock device or structure of this invention.

An attachment member 78 comprises a bracket 80 which has an upper wall 80*a*, an end wall 80*b*, side walls 80*c* and 80*d*, 80*e* and 80*f*. Integral with the side wall 80*c* and 80*d* and extending therefrom are arms 84. Each of the arms 84 is provided with a series of apertures 85. The bracket 80 is positioned upon the upper corner of a door 86, and the upper wall 80*a* of the bracket 80 covers a portion of the upper surface of the door 86. The end wall 80*b* covers a portion of the end surface of the door 86. The side walls 80*c* and 80*d* cover a portion of one side surface of the door 86 and the side wall 80*e* and the side wall 80*f* cover a portion of the opposite side surface of the door 86. The arms 84 extend from the side walls 80*c* and 80*d* of the bracket 80. The arms 84 extend from the door 86 to a position beyond a door frame 88, within which the door 86 is hingedly mounted. The door frame 88 has a vertical portion 88V and a horizontal portion 88H.

Figure 8:
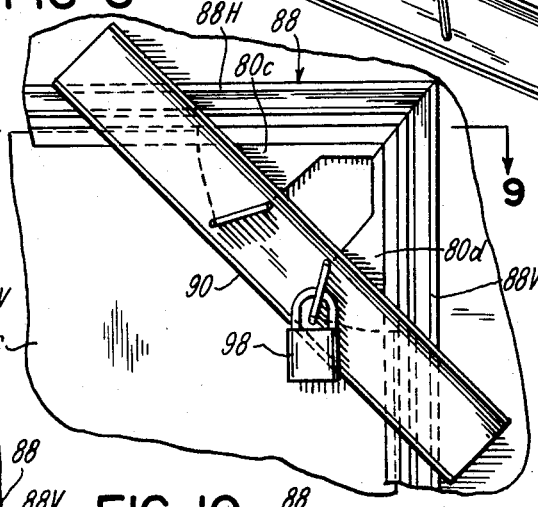
FIG. 8 is a fragmentary front elevational view similar to FIG. 3, showing the modification of FIGS. 6 and 7.
Figure 9:
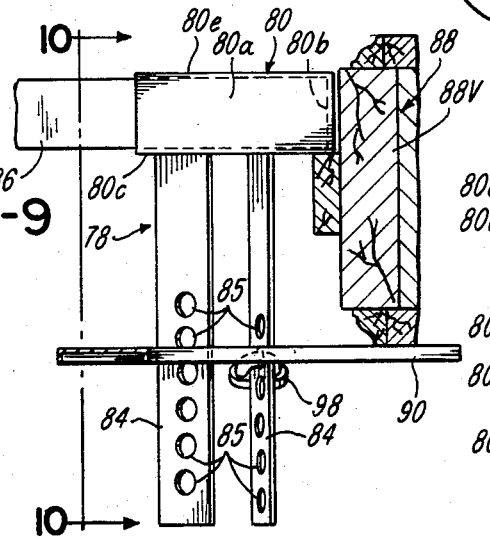
FIG. 9 is a sectional view taken substantially on line 9—9 of FIG. 8.
Figure 10:
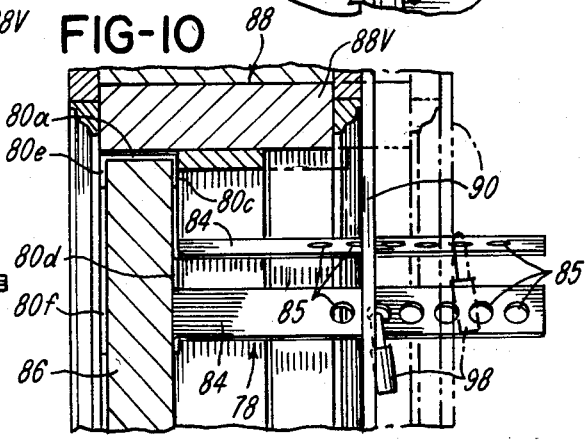
FIG. 10 is a sectional view taken substantially on line 10—10 of FIG. 9.

When the attachment member 78 is mounted upon the door 86 and when the door 86 is in a closed condition a retainer plate 90 is placed upon the arms 84. The retainer plate 90 is provided with openings 92. The retainer plate 90 is positioned upon the arms 84 with the arms 84 extending through the openings 92. When the retainer plate 90 is positioned upon the arms 84, the retainer plate 90 is moved to a position closely adjacent the portions 88H and 88V of the door frame 88, as shown in FIGS. 8, 9, and 10. Then a padlock 98 or the like is attached to at least one of the arms 84, as a part of the padlock extends through at least one of the openings 85 in one of the arms 84, as shown in FIGS. 8, 9, and 10.

FIG. 10 illustrates that the arms 84 are longer than the width of the door frame 88 and extend beyond the door frame 88. FIG. 10 also shows that the position of the retainer plate 90 is adjustable upon the arms 84, as the retainer plate 90 is positioned as close as possible to the door frame 88. FIG. 10 illustrates that the dimensions of a door frame 88 may be different in various types or installations, and the arms 84 are sufficiently long to extend beyond the door frame 88, regardless of the dimensions of the door frame 88. A door lock device of this invention is thus adjustable to accommodate a door frame of any width dimension.

FIG. 10 also illustrates that the locations of the apertures 85 in the arms 84 are such that the retainer plate 90 is positioned adjacent at least one of the apertures 85 when the retainer plate 90 is in juxtaposition with the door frame 88. Thus, a proper aperture 85 is available to receive the padlock 98 to maintain the retainer plate 90 in juxtaposition with the door frame 88 to secure the door 86 in closed position.

Figure 11:
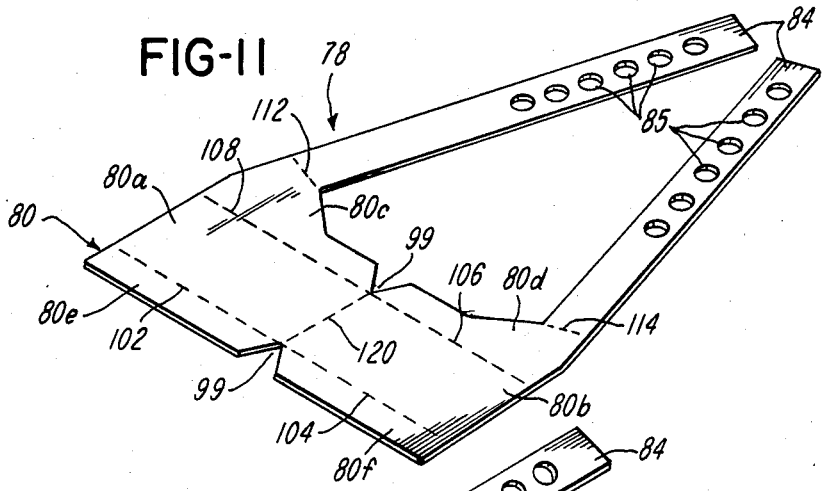
FIG. 11 is a perspective view illustrating a first step in the production of an attachment member which is a part of the locking device shown in FIGS. 6–10.
Figure 12:
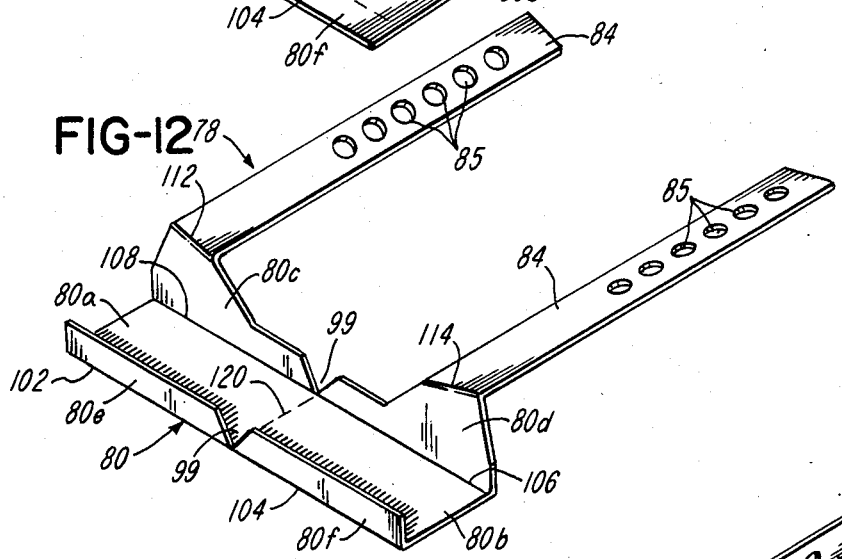
FIG. 12 is a perspective view illustrating a succeeding step in the production of the attachment member of FIGS. 6–10.
Figure 13:
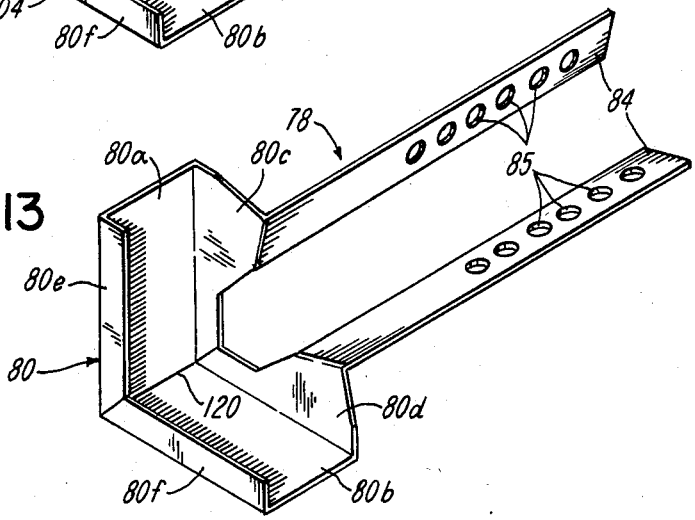
FIG. 13 is a perspective view illustrating the final step in the production of the attachment member in FIGS. 6–10.

FIGS. 11, 12, and 13 illustrate the manner in which the attachment member 78 is produced as an integral unit. A flat piece of sheet metal material or other suitable rigid material is formed, as shown in FIG. 11, to include the bracket portion 80 and the arm portions 84, with the apertures 85 within the arms 84. Notches 99 are formed in the bracket portion 80. Then side walls 80*c*, 80*d*, 80*e* and 80*f* are formed by bending along lines 108, 106, 102, and 104, respectively, as shown in FIG. 12. Also, as shown in FIG. 12, the arms 84 are formed to extend from the side walls 80*c* and 80*d* by bending along lines 112 and 114. Then the upper wall 80*a* and the end wall 80*b* are formed by bending along the line 120, as illustrated in FIG. 13. Thus, the bracket 80 and the arms 84 are integral and formed from a single sheet of material.

Although the preferred embodiments of the temporary door lock device or structure of this invention and methods of construction have been described, it will be understood that within the purview of this invention various changes may be made in the form, details, proportion and arrangement of parts, the combination thereof, the method of construction and the mode of use, which generally stated consist in an invention within the scope of the appended claims.

The invention having thus been described, the following is claimed.

1. A locking device for temporarily securing a door to a door frame pivotally supporting the door for swinging movement between a closed position and an open position, the intended door frame being of the type having a horizontal upper member connected to a vertical side member, and the intended door being of the type having an upper corner portion with a horizontal top edge surface and a vertical outer edge surface connecting opposite side surfaces, the locking device comprising a corner bracket for receiving the upper corner portion of the door, the corner bracket including a top wall and an end wall in perpendicular relation and connecting parallel opposing side walls, the top wall of the corner bracket being disposed for engaging the top edge surface of the door and the end wall of the corner bracket being disposed for engaging the vertical edge surface of the door with the opposing side walls disposed for engaging the opposite side surfaces of the door, an arm secured to one of the side walls of the bracket and projecting perpendicular from the one side wall, the arm having at least one aperture therein, a substantially flat rigid retainer plate having an opening therein for receiving the arm projecting from the bracket, the retainer plate including portions disposed for engaging the horizontal upper member and the vertical side member of the door frame, and a lock including a portion extending through the aperture in the arm for securing the retainer plate to the arm with the retainer plate in position to engage the horizontal and vertical members of the door frame when the door is in the closed.

2. A locking device for temporarily securing a door to a door frame pivotally supporting the door for swinging movement between a closed position and an open position, the intended door frame being of the type having a horizontal upper member connected to a vertical side member, and the intended door being of the type having an upper corner portion with a horizontal top edge surface and a vertical outer edge surface connecting opposite side surfaces, the locking device comprising a corner bracket for receiving the upper corner portion of the door, the corner bracket including a top wall and an end wall in perpendicular relation and connecting parallel opposing side walls, the top wall of the corner bracket being disposed for engaging the top edge surface of the door and the end wall of the corner bracket being disposed for engaging the vertical edge surface of the door with the opposing side walls disposed for engaging the opposite side surfaces of the door, an arm secured to one of the side walls of the bracket and projecting perpendicular from the one side wall, the arm having at least one aperture therein, a substantially flat rigid retainer plate having an opening therein for receiving the arm projecting from the bracket, the retainer plate including portions disposed for engaging the horizontal upper member and the vertical side member of the door frame, and a lock including a portion extending through the aperture in the arm for securing the retainer plate to the arm with the retainer plate in position to engage the horizontal and vertical members of the door frame when the door is in the closed position, the corner bracket and the arm being integral and formed from a single sheet of rigid material.

3. A locking device for temporarily securing a door to a door frame pivotally supporting the door for swinging movement between a closed position and an open position, the intended door frame being of the type having a horizontal upper member connected to a vertical side member, and the intended door being of the type having an upper corner portion with a horizontal top edge surface and a vertical outer edge surface connecting opposite side surfaces, the locking device comprising a corner bracket for receiving the upper corner portion of the door, the corner bracket including a top wall and an end wall in perpendicular relation and connecting parallel opposing side walls, the top wall of the corner bracket being disposed for engaging the top edge surface of the door and the end wall of the corner bracket being disposed for engaging the vertical edge surface of the door with the opposing side walls disposed for engaging the opposite side surfaces of the door, a pair of arms secured to one of the side walls of the corner bracket and projecting perpendicular from said side wall, each of the arms having a plurality of apertures therethrough, a substantially flat rigid retainer plate having openings therein for receiving the arms which project from the corner bracket, the retainer plate including portions disposed for engaging the horizontal upper member and the vertical side member of the door frame, and a lock including a portion extending through an aperture in one of the arms for securing the retainer plate to the arms with the retainer plate in position to engage the horizontal and vertical members of the door frame when the door is in the closed position.

4. A locking device for temporarily securing a door to a door frame pivotally supporting the door for swinging movement between a closed position and an open position, the intended door frame being of the type having a horizontal upper member connected to a vertical side member, and the intended door being of the type having an upper corner portion with a horizontal top edge surface and a vertical outer edge surface connecting opposite side surfaces, the locking device comprising a corner bracket for receiving the upper corner portion of the door, the corner bracket including a top wall and an end wall in perpendicular relation and connecting parallel opposing side walls, the top wall of the corner bracket being disposed for engaging the top edge surface of the door and the end wall of the corner bracket being disposed for engaging the vertical edge surface of the door with the opposing side walls disposed for engaging the opposite side surfaces of the door, an arm secured to one of the side walls of the bracket and projecting perpendicular from the one side wall, the arm having at least one aperture therein, a substantially flat rigid retainer plate having an opening therein for receiving the arm projecting from the bracket, the retainer plate including portions disposed for engaging the horizontal upper member and the vertical side member of the door frame, and a lock including a portion extending through the aperture in the arm for securing the retainer plate to the arm with the retainer plate in position to engage the horizontal and vertical members of the door frame when the door is in the closed position, the corner bracket and the arm being of rigid metallic material.

* * * * *